US007221236B2

(12) United States Patent
Liess et al.

(10) Patent No.: US 7,221,236 B2
(45) Date of Patent: May 22, 2007

(54) WAVEGUIDE COMMUNICATION SYSTEM

(75) Inventors: Martin Dieter Liess, Eindhoven (NL); Lukas Leyten, Eindhoven (NL); Diego Sommavilla, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/510,790

(22) PCT Filed: Mar. 19, 2003

(86) PCT No.: PCT/IB03/01117

§ 371 (c)(1),
(2), (4) Date: Oct. 12, 2004

(87) PCT Pub. No.: WO03/088407

PCT Pub. Date: Oct. 23, 2003

(65) Prior Publication Data

US 2005/0128024 A1 Jun. 16, 2005

(30) Foreign Application Priority Data

Apr. 17, 2002 (EP) ..... 02076503

(51) Int. Cl.
*H01P 1/04* (2006.01)
*H01P 5/04* (2006.01)

(52) U.S. Cl. ..... 333/24 R; 333/24 C

(58) Field of Classification Search ..... 333/24 R, 333/24 C, 26, 109, 111, 113, 185, 239, 248
See application file for complete search history.

(56) References Cited

U.S. PATENT DOCUMENTS

| | | | | |
|---|---|---|---|---|
| 2,496,837 A | | 2/1950 | Woodyard | |
| 4,054,850 A | * | 10/1977 | Gerrish | 333/24 R |
| 4,433,313 A | * | 2/1984 | Saint et al. | 333/109 |
| 6,956,450 B1 | * | 10/2005 | Lohr | 333/261 |

FOREIGN PATENT DOCUMENTS

| | | |
|---|---|---|
| CH | 578964 A | 8/1976 |
| DE | 1 952 797 A | 4/1971 |
| DE | 25 55 909 A | 6/1977 |
| WO | WO9829919 | 7/1998 |

OTHER PUBLICATIONS

H. Dalichau and disclosed in, for instance, "Adapters and vehicles-couplers for slotted waveguide systems", Frequenz 36 (1982), p. 169-175.

* cited by examiner

*Primary Examiner*—Dean Takaoka
(74) *Attorney, Agent, or Firm*—Aaron Waxler; Paul Im

(57) ABSTRACT

A waveguide comprises a longitudinal first conductor (110) located in an inner space of a box-shaped longitudinal shield conductor which is provided with a slot (122) defining a sliding support for a substantially plate-shaped coupler (300). The shield conductor (120) is provided with flanges (125, 126) extending substantially parallel to each other on opposite sides of the slot (122). A coupling conductor portion (322) faces the first conductor (110).

23 Claims, 8 Drawing Sheets

WAVEGUIDE COMMUNICATION SYSTEM

The present invention relates in general to a system for transferring signals from a sender to a receiver, either the sender or the receiver, or both, being mobile. Specifically, the present invention relates to a communication system for use in an industrial apparatus for manufacturing products, of the type where a mobile actuator performs tasks at a range of locations, such as for instance picking up components in one location and placing the components in a different location. Such actuator needs to be given commands or control signals from a source in the fixed world.

In the following, the invention will be more specifically explained for a situation where a sender is fixed while a receiver is mobile. However, it is to be understood that the present invention is not restricted to such situation. In contrast, the present invention is likewise applicable in a situation where a sender is mobile while a receiver is fixed, and also in a situation where both the sender and the receiver are mobile. Further, it is possible to use the invention in a case of multiple mobile stations, each functioning as sender/receiver in multipoint communication system.

Conventionally, signals are transferred as electrical signal by electrical cables. However, the use of electrical cables has some disadvantages.

First, the electrical cable must be able to follow the movements of the receiver, so the cable must be mounted as a loose cable.

Second, because of the repeating movement of the receiver and thus of the repeated movement of the cable, the cable is vulnerable, and in fact it may eventually break. When this happens, the apparatus concerned must be shut down in order to repair the cable. Also, if signals do not reach the actuator because of a broken cable, it is possible that the actuator causes further damage to the apparatus.

Third, apart from the chance on failure, the moving actuator must exert mechanical forces on the cable in order to pull the cable along with the actuator, and such forces may affect the accuracy of positioning.

For these and other reasons, it is already known to use a wireless communication path from a control unit to an actuator. It is possible to use wireless communication in "open air", but this involves the risk of interference by electromagnetic fields from other sources, and/or generating electromagnetic fields which may disturb other electronic components. In order to avoid this problem, a wireless communication path comprises a microwave RF signal guided by a waveguide. The waveguide is typically attached to the fixed world. A microwave signal is inputted into the waveguide at one end thereof. The movable actuator is provided with a coupler, movably associated with the waveguide, so that the coupler can pick up a signal from the waveguide within a range of positions.

FIG. 1 schematically illustrates a waveguide according to the state of the art.

A prior art waveguide 10 is a box-like structure with a rectangular cross-section, having a bottom 11 with a width W, sidewalls 12 and 13 with height H, and an upper wall 14. The walls 11, 12, 13, 14 are electrically conductive; typically, they are made from iron or steel. A slot 15 runs in the longitudinal direction of the center of the upper wall 14. The slot 15 is flanked by upright flanges 16. The bottom 11, and walls 12, 13, 14 enclose a waveguide chamber 17, in which an RF wave can be generated by means not shown in FIG. 1. A pickup coupler, schematically shown as a square 19 in FIG. 1, is mounted on a support 18 which extends through the slot 15, and which is movable in the longitudinal direction of the waveguide 10, so that the coupler can travel the length of the waveguide 10. The support 18 is associated with a movable actuator, and is capable of carrying signals from the coupler 19 to the actuator, which is not shown in FIG. 1.

This known waveguide 10, invented by H. Dalichau and disclosed in, for instance, "Adapters and vehicles-couplers for slotted waveguide systems", Frequenz 36 (1982), p.169–175, has some serious disadvantages. The most important disadvantage is that the state of the art waveguide 10 has a narrowband transfer characteristic and has especially to be designed for one predetermined carrier frequency. As such, in order to have a bandwidth less than an octave, the width W of the bottom 11 must be equal to $\lambda$, and the height H of the sidewalls 12 and 13 must be equal to $\lambda/2$, wherein $\lambda$ is the wavelength of said predetermined carrier wave.

This limits the data transfer capacity of the wave guide. Further, since the carrier frequency is determined by the sender, different waveguides must be designed for different senders using different carrier frequencies.

Another problem relates to the size. At present, commercially available communication modules work at frequencies lower than 6 GHz. Then, the characterizing dimension W of the waveguide is larger than 5 cm. This means that the waveguide occupies a substantial amount of space within an apparatus.

An important objective of the present invention is to overcome the above-mentioned disadvantages.

Specifically, an objective of the present invention is to provide an improved waveguide which has smaller dimensions and has a broadband transfer characteristic. More particularly, the present invention aims to provide a waveguide capable of transferring waves with a frequency in the range of 1 GHz or lower to 6 GHz or higher.

According to an important aspect of the present invention, a waveguide comprises two parallel conductors, one being hollow and enclosing a waveguide chamber, the other being arranged inside this waveguide chamber. The hollow outer conductor confines the electromagnetic energy of the transferred signal substantially completely to the interior of said waveguide chamber. The hollow outer conductor has at least one slot, allowing a coupler to be introduced into said waveguide chamber, and to be displaced along the length of the waveguide, such as to pick up (or introduce) energy from (or to) the waveguide at any desired location along the length of the waveguide.

It is noted that so-called "leaky waveguides" exist, which are intentionally constructed such that a predetermined portion of the electromagnetic energy of the transferred signal leaks out towards the surroundings. Such leaky waveguide is typically implemented as a coaxial cable, having a hollow outer conductor and an inner conductor placed coaxially inside the outer conductor, the space between the inner conductor and the inner wall of the outer conductor being completely filled with a dielectric material. The outer conductor is provided with a plurality of small openings, in a regular pattern, through which electromagnetic field can leave the interior of the outer conductor. The openings have dimensions typically smaller than the wavelength. Such a leaky waveguide, too, allows pick up of signal at any desired location along its length, but in this case by using an antenna outside the waveguide. A typical example of an application of such leaky waveguide is in a tunnel, for providing radio signals to cars. The waveguide is, however, not suitable for the introduction of a travelling coupler into the interior of the waveguide.

These and other aspects, features and advantages of the present invention will be further explained by the following description of preferred embodiments of the waveguide according to the present invention with reference to the drawings, in which same reference numerals indicate same or similar parts, and in which:

FIG. 1 schematically shows a perspective view of a prior art waveguide;

FIG. 2 schematically illustrates some basic elements of a waveguide according to the present invention;

Figure 11A:
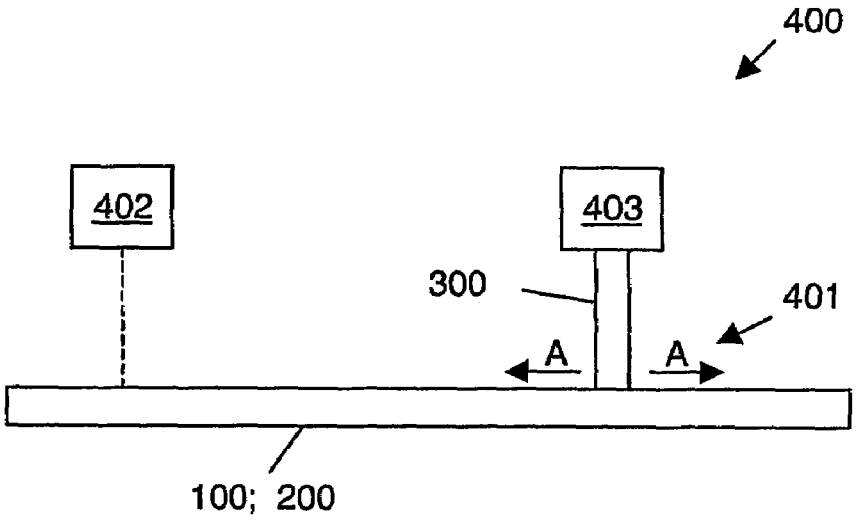
Figure 11B:
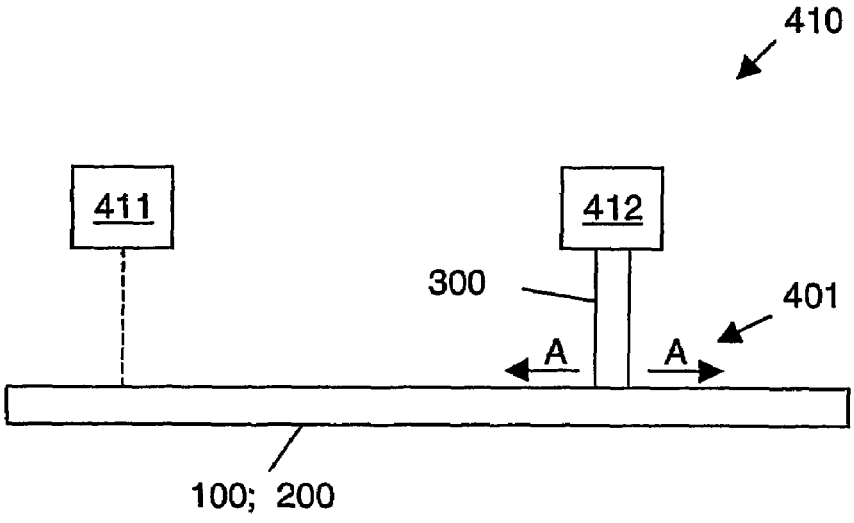

FIGS. 11A and 11B schematically illustrate an apparatus with a waveguide communication system in accordance with the present invention.

The present invention proposes a multiple conductor waveguide 100 comprising a first conductor 110 enclosed in a second conductor 120, also indicated as shield conductor, that also provides a shielding of the electromagnetic field.

Figure 2:
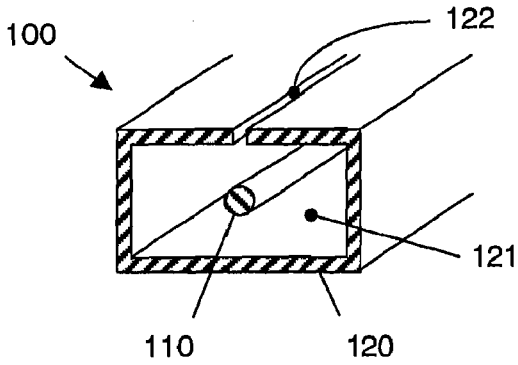

FIG. 2 schematically illustrates some basic elements of a first embodiment of a multiple-conductor waveguide 100 proposed by the present invention. In this first embodiment, the shield conductor 120 in general has the shape of a box extending around the first conductor 110. The second conductor 120, in the shape of a hollow box extending around the first conductor 110, thus defines an inner space or waveguide chamber 121 in which the first conductor 110 is located. FIG. 2 also illustrates that the second conductor 120 is provided with a longitudinal slot 122, of which the function will be explained later.

In use, a signal will be applied to the first conductor, and travels the length of the conductors, causing an electromagnetic field in the inner space 121. As will be clear to a person skilled in the art, the electromagnetic field will be confined within this interior 121, i.e. no or very little electromagnetic field will be generated outside the second conductor 120, so no or very little interference with other electronics will be caused. Conversely, outside electromagnetic fields will not penetrate into the interior 121, so that no or very little interference from outside electromagnetic fields will result.

Figures 3A, 3B, 3C, 3D, 3E:
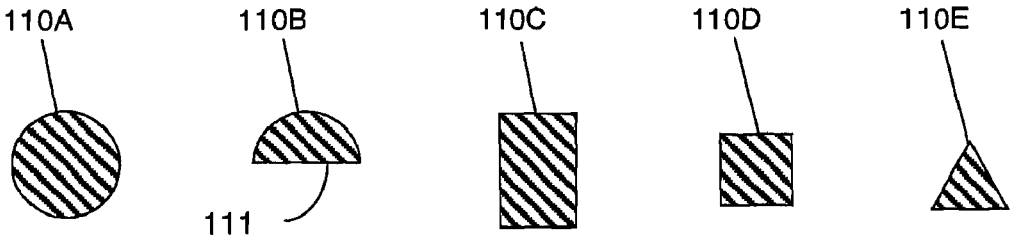
FIGS. 3A–3E are cross-sections of inner conductors of a waveguide according to the present invention, illustrating several design possibilities.

FIGS. 3A–D illustrate some design details of the shape of the first conductor 110. As illustrated in FIG. 3A, the first conductor 110A may have a circular cross-section. As illustrated in FIGS. 3B–3E, the first conductor may also have at least one flat side surface 111. In the embodiment 110B illustrated in FIG. 3B, the first conductor 110B has a substantially D-shaped cross-section with only one flat side surface 111. In a third embodiment illustrated in FIG. 3C, the first conductor 110C has a rectangular square cross-section, having four substantially flat side surfaces. In a fourth embodiment illustrated in FIG. 3D, the first conductor 110C has a square cross-section, having four substantially flat side surfaces. In a fifth embodiment illustrated in FIG. 3E, the first conductor 110D has a substantially triangular cross-section, having three substantially flat side surfaces.

FIG. 4 illustrates some design elements of the second conductor 120 (the slot 122 being omitted in FIG. 4 for sake of simplicity). As illustrated in FIG. 4A, the second conductor 120A may have a substantially rectangular or even square cross-section, similar to the cross-section of the state of the art waveguide 10 illustrated in FIG. 1. However, the design of the second conductor 120 is no longer limited to a rectangular design. As illustrated in FIG. 4B, the second conductor may have a substantially circular shape. As illustrated in FIG. 4C, the second conductor may have a substantially square shape. As illustrated in FIG. 4D, the second conductor 120D may have a substantially D-shaped cross-section. As illustrated in FIG. 4E, the second conductor 120E may have a substantially triangular cross-section.

In fact, the second conductor 120 may have any suitable shape, wherein the main design criterion will be the fact that the second conductor should envelope the first conductor 110 such that the field lines are confined to the interior 121 of the second conductor 120. Design choices relating to the shape of the second conductor 120 will now be made mainly with a view to manufacturing.

Figure 1:
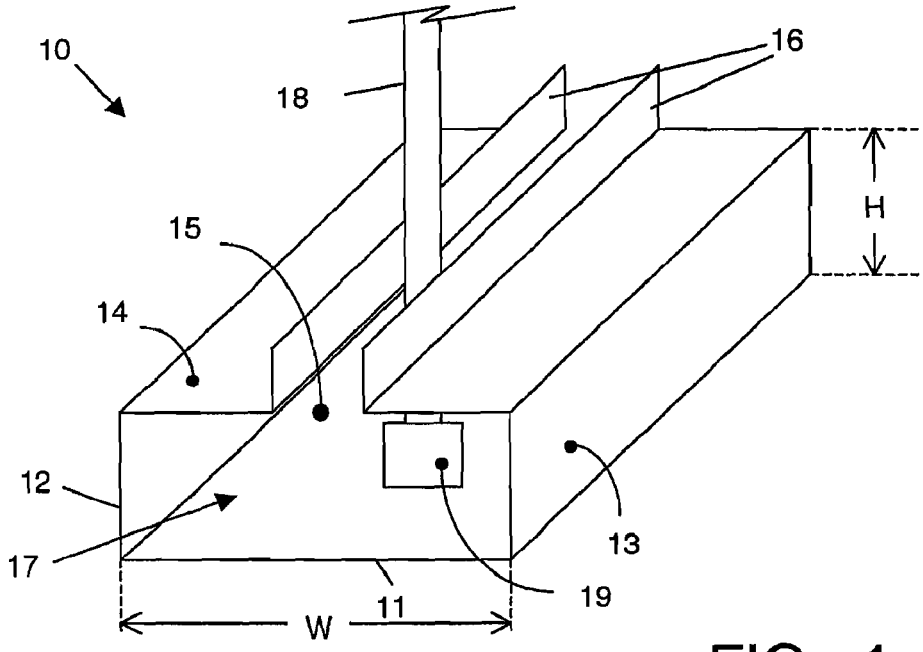
FIG. 1 PRIOR ART

In this respect, it is pointed out that, in the state of the art waveguide 10 as illustrated in FIG. 1, there are no design options relating to the shape of the waveguide: as mentioned, it must have a rectangular cross-section having a width W twice as large as the height H and being equal to the wavelength $\lambda$ of the design carrier frequency. In contrast, no such limitations apply to the second conductor 120 of the multiple-conductor waveguide 100 proposed by the present invention. Not only is it possible to use, basically, any shape of cross-section, but also the dimensions of the cross-section can be chosen much smaller.

As already mentioned with reference to FIG. 2, the second conductor 120 of the multiple-conductor waveguide 100 of the present invention comprises at least one longitudinal slot for allowing introduction of a coupler, examples of which will be described later. For sake of convenience, such slot has not been shown in FIGS. 4A–4E. Such slot 122 is illustrated in FIG. 5, in which FIGS. 5A–5D illustrate several design possibilities. Details of the slot 122 will be explained in FIG. 5 in conjunction with the rectangular embodiment 120A illustrated in FIG. 4A and the triangular second conductor 120E illustrated in FIG. 4E, but it should be clear that the same principles apply to all other types of second conductors.

Figure 5A:
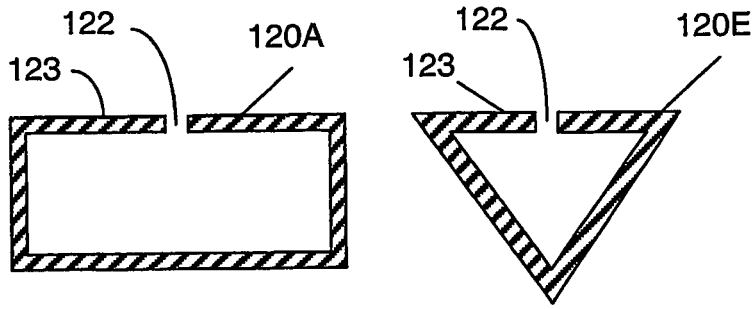
FIGS. 5A–5D are cross-sections of outer conductors of a waveguide according to the present invention, illustrating several design possibilities.
Figure 5B:
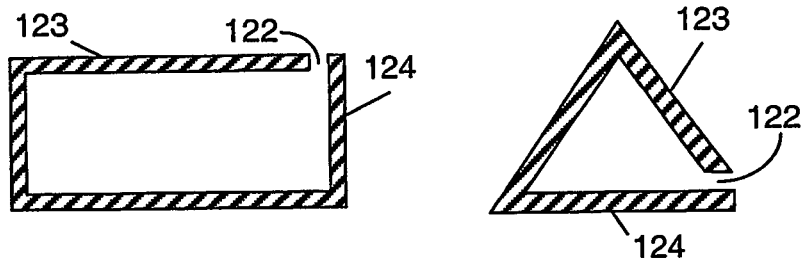

As illustrated in FIG. 5A, the slot 122 may be located symmetrically, in the center of a side wall 123 of the second conductor 120. However, according to the present invention, the second conductor 120 is not limited to this design, as is the prior art waveguide 10 illustrated in FIG. 1. As illustrated in FIG. 5B, the slot 122 may also be located near a corner of the profile, i.e. the slot 122 may be arranged near the edge of a side wall 123, adjacent a neighboring side wall 124. In fact, the slot 122 may be located at any suitable position on a side wall.

The slot 122 may be very narrow, depending on the size of a coupler to be introduced in the slot 122. If the slot 122 is sufficiently narrow, an electromagnetic field having a frequency in the range considered (about 1 GHz to about 6 GHz or even higher) hardly passes such a slot. A further improvement in this respect can be offered by arranging flanges 125, 126, extending substantially parallel to each other on opposite sides of the slot 122. Such flanges 125, 126, may be arranged on opposite sides of a slot 122 in the center of a wall 123 as illustrated in FIG. 5A; in that case, such flanges will both be arranged substantially perpendicular to said sidewall 123. This is not illustrated separately. In the embodiment illustrated in FIG. 5C, where the slot 122 is located in a corner of the profile, the flanges may be arranged such that a first flange 125 extends in line with the adjacent side wall 124 while the second flange 126 extends in parallel to the first mentioned flange 125.

Figure 5C:
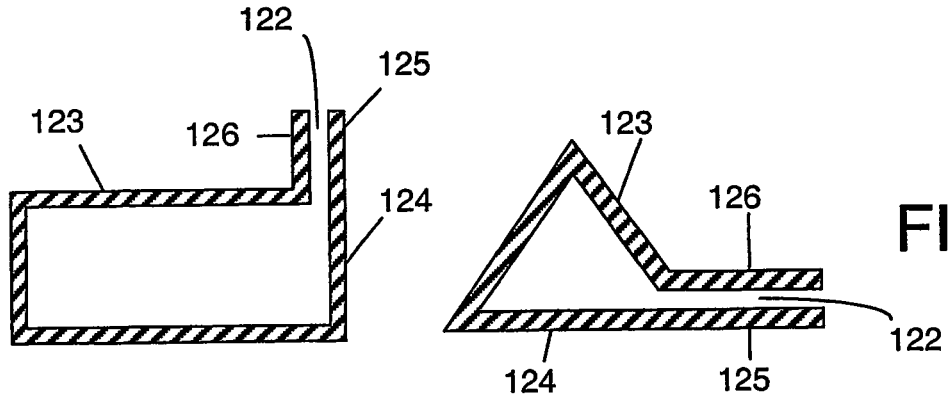
Figure 5D:
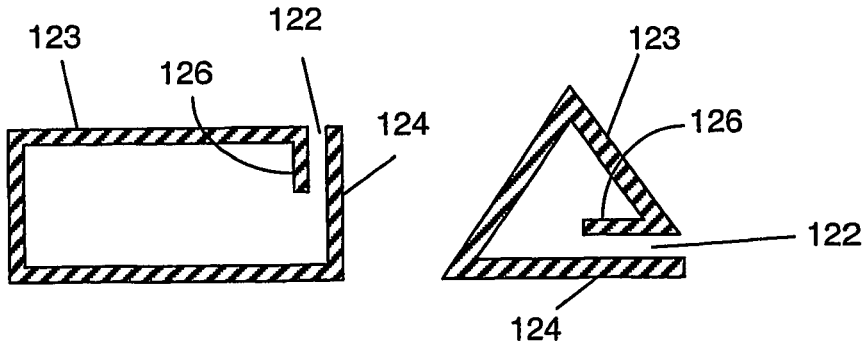

As illustrated in FIG. 5C, the flanges 125, 126 may extend outwards from the second conductor 120. Preferably, however, the flanges 125, 126 may extend inwards, as illustrated in FIG. 5D. As can be seen from FIG. 5D, the slotted second conductor 120 now effectively comprises only one additional flange 126 extending from the edge of said side wall 123 into the interior 121, in parallel to said adjacent side wall 124. The portion of this adjacent side wall 124 which overlaps with said additional flange 126 now effectively performs the function of flange 125.

An important advantage of the embodiments illustrated in FIGS. 5C and 5D when comparing with the embodiment of FIG. 5A when provided with flanges, is that the embodiments of FIGS. 5C and 5D are more easy to produce. Typically, production will involve folding a box-like structure from a flat sheet or plate of metal, the side walls and flanges being produced by folding this sheet or plate of metal. In the case of FIG. 5C, the first flange 125 does not involve a folding operation, since it is formed as a simple extension of the adjacent side wall 124. In the case of FIG. 5D, the further advantage is achieved that the flanges do not project outwards from the shield conductor 120, and providing the first flange 125 does not involve addition of material.

An important advantage of the embodiments illustrated in FIGS. 5C and 5D is that they provide a better confinement of the electromagnetic field within the interior 121, because the electromagnetic field decays exponentially between the flanges, whose distance is less than half the wavelength. This advantage applies in the embodiment of FIG. 5D and in the embodiment of FIG. 5C.

Figure 4A:
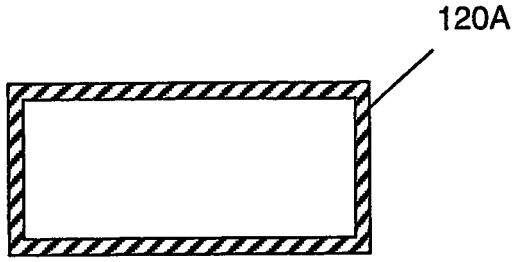
FIGS. 4A–4E are cross-sections of outer conductors of a waveguide according to the present invention, illustrating several design possibilities.

In a special embodiment, the second conductor 120 has a rectangular shape (such as illustrated in FIG. 4A), having two opposite long sidewalls and two opposite short sidewalls, wherein the slot 122 is arranged in one of the short sidewalls. Now the length of the short sidewall may be equal or only slightly larger than the width of the slot 122, so that effectively the slot 122 occupies the entire length of the short sidewall. The second conductor 120 now might be considered as having only three sidewalls in a U-shaped configuration, wherein the two opposite long sidewalls effectively perform the function of flanges as mentioned above.

Figure 6A:
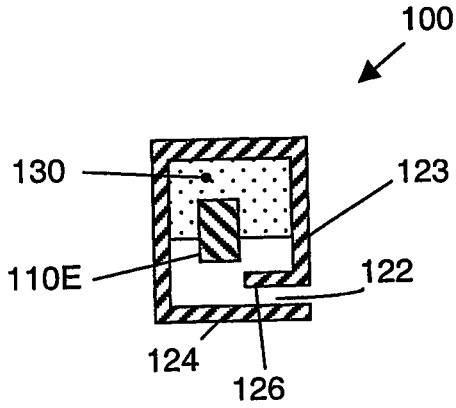
FIGS. 6A and 6B are a cross-section and a longitudinal partial section, respectively, of an embodiment of a waveguide according to the present invention.
Figure 6B:
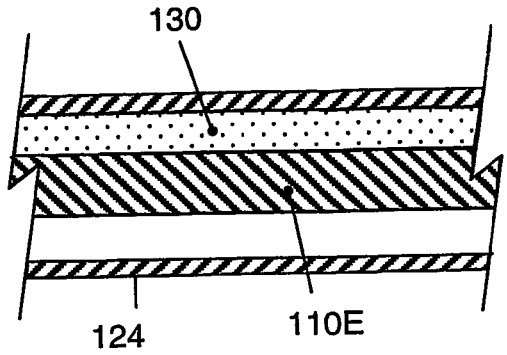

The first conductor 110 in the interior 121 of the second conductor 121 may be hanging free, suspended at its ends. Depending on the cross-sectional shape of the first conductor 110, among else, the first conductor 110 may have sufficient stiffness and/or may be subjected to tension forces in order to be directed according to a straight line as much as possible, if the longitudinal shape of the waveguide is straight. However, in practice a more or less degree of sagging will then hardly be avoidable. In order to avoid such sagging, it may be desirable to arrange one or more supports in the interior 121, to support the first conductor 110 with respect to the second conductor 120. However, such supports will locally involve a change in impedance, which may cause reflections, which is undesirable. Preferably, the impedance of the waveguide is as constant as possible over its length. Therefore, in case a support for the first conductor 110 is desirable, such support preferably is a continuous support, i.e. extending over the entire length of the first conductor 110 with continuous properties. By way of example, FIGS. 6A and 6B illustrate an embodiment of a waveguide 100 comprising a second conductor 120 as illustrated in FIG. 5D and a first conductor 110C as illustrated in FIG. 3C, the first conductor 110C being supported by a continuous support 130 of a non-conductive material, such as for instance plastics. Alternatively, a discontinuous support can be used as long as the dimensions of and distances between the support structures are significantly smaller than the wavelength.

Figure 7A:
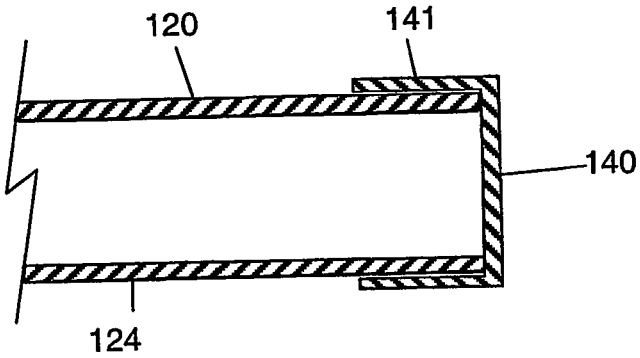
FIG. 7A is a longitudinal section of an end portion of a shield conductor, schematically illustrating a terminator.
Figure 7B:
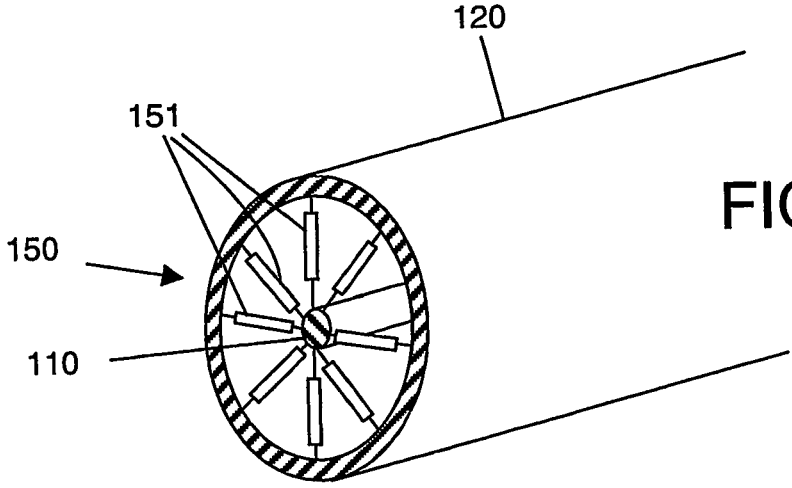
FIG. 7B is a perspective view of an end portion of a waveguide, schematically illustrating another terminator.
Figure 7C:
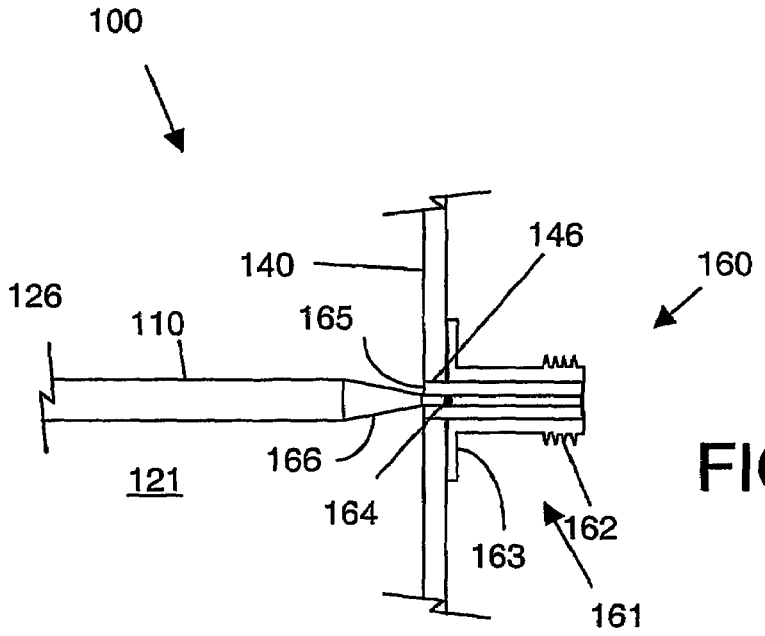
FIG. 7C is a longitudinal section of an end portion of a waveguide, on an enlarged scale, schematically illustrating a feed through connector.

It is not desirable to have the second conductor 120 open-ended. FIGS. 7A–7C illustrate several possibilities for an end construction of the second conductor 120.

As illustrated in FIG. 7A, the second conductor 120 may be ended by a conductive end wall 140, electrically connected to the longitudinal walls of the second conductor 120. Such end wall 140 may be implemented as a plate welded to the ends of the walls of the second conductor 120, but the end wall 140 may also be implemented as a substantially cylindrical cap having a bottom 140 and a cylindrical side wall 141, having a contour corresponding to the contour of the second conductor 120, as schematically illustrated in FIG. 7A. Such conductive end wall 140 will substantially reflect travelling electromagnetic fields, and will therefore also be referred to as reflector 140.

Figure 4B:
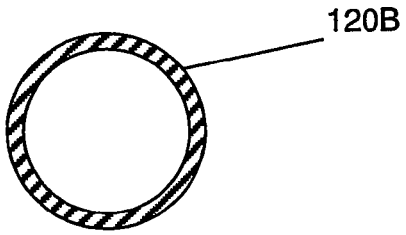
Figure 4C:
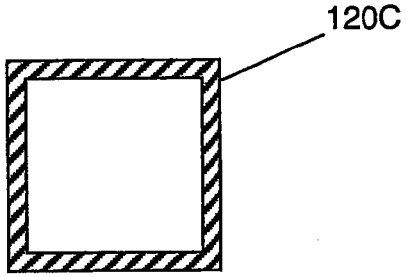
Figure 4D:
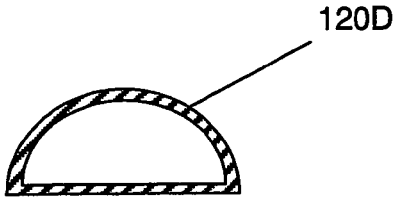
Figure 4E:
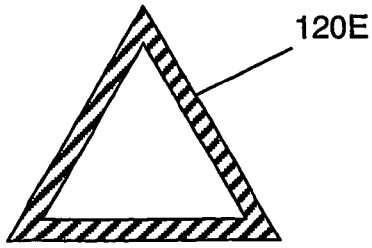

In case it is desirable to avoid such reflections, the end construction may comprise a terminator 150 having an impedance matching the impedance of the waveguide 100. Alternatively to a terminator, the signal can be extracted from the construction for example via a connector and used otherwise, for example to be inserted into another waveguide. Multiple wave-guides can be connected in a chain-configuration and be used as the back bone of a network with multiple mobile couplers in different waveguides. FIG. 7B schematically illustrates an example of a waveguide 100 having a first conductor 110 with a substantially circular cross-section, as the first conductor 110A illustrated in FIG. 3A, and a second conductor 120 having a substantially circular profile, as illustrated in FIG. 4B. The terminator 150 in this example comprises a plurality of resistors mounted in a star-like configuration, each resistor 151 being substantially radially directed between the first conductor 110 and the second conductor 120, having one terminal connected to the main conductor 110 and having the other terminal connected to the second conductor 120, wherein the resistors 151 are distributed evenly around the main conductor 110. In effect, all resistors 151 are connected in parallel between the main conductor 110 and the second conductor 120, and present an effective resistance, as will be clear to a person skilled in the art, which should match the impedance of the waveguide 100.

Instead of a plurality of individual resistors 151, the terminator 150 may also comprise an annular-shaped conductor arranged between the first conductor 110 and the second conductor 120, this annular resistor presenting the matching resistance between first conductor 110 and second conductor 120. Also microwave absorber materials can be used to terminate the waveguide.

FIG. 7C illustrates, on an enlarged scale, a modification of the embodiment illustrated in FIG. 7A. Again, the end construction comprises a conductive plate 140 extending substantially perpendicular to the longitudinal direction of the waveguide 100. In the embodiments illustrated in FIG. 7C, the end wall 140 is provided with a feed through connector 160 of the coaxial type. The feed through connector comprises a cylindrical outer conductor 161 with a circular profile, provided with screw thread 162 at one end and a mounting flange 163. An inner conductor, also called pin, 164 extends coaxially within the outer conductor 161 and is connected to the first conductor 110. An end portion 166 of the first conductor 110 is tapered such as to bring the cross size of the first conductor 110 down to the cross size of the pin 164 in order to reduce reflections and undesired effects, such as fringing electromagnetic fields. A dielectric insulator 165 is arranged between the pin conductor 164 and the outer conductor 161. The end plate 140 is provided with a hole 146, through which at least the pin conductor 164 of the connector 160 extends. The connector 160 is suitable for connecting a coax cable (not shown) carrying a signal to be transferred, wherein a connector of the coax cable will be screwed onto the connector 160. In the interior 121 of the second conductor 120, an end of the first conductor 110 will be connected to the pin conductor 164 of the connector 160, as illustrated.

The waveguide 100 is preferably implemented as a rigid, self-supporting structure, directed according to a straight line. However, this is not essential, and alternatives may even be advantageous in some cases. For instance, it may be advantageous that the waveguide follows at least partially a curved path. Also, it may be advantageous if the waveguide is bendable, in order to be able to adapt its shape to the actual location of implementation.

Figure 8:
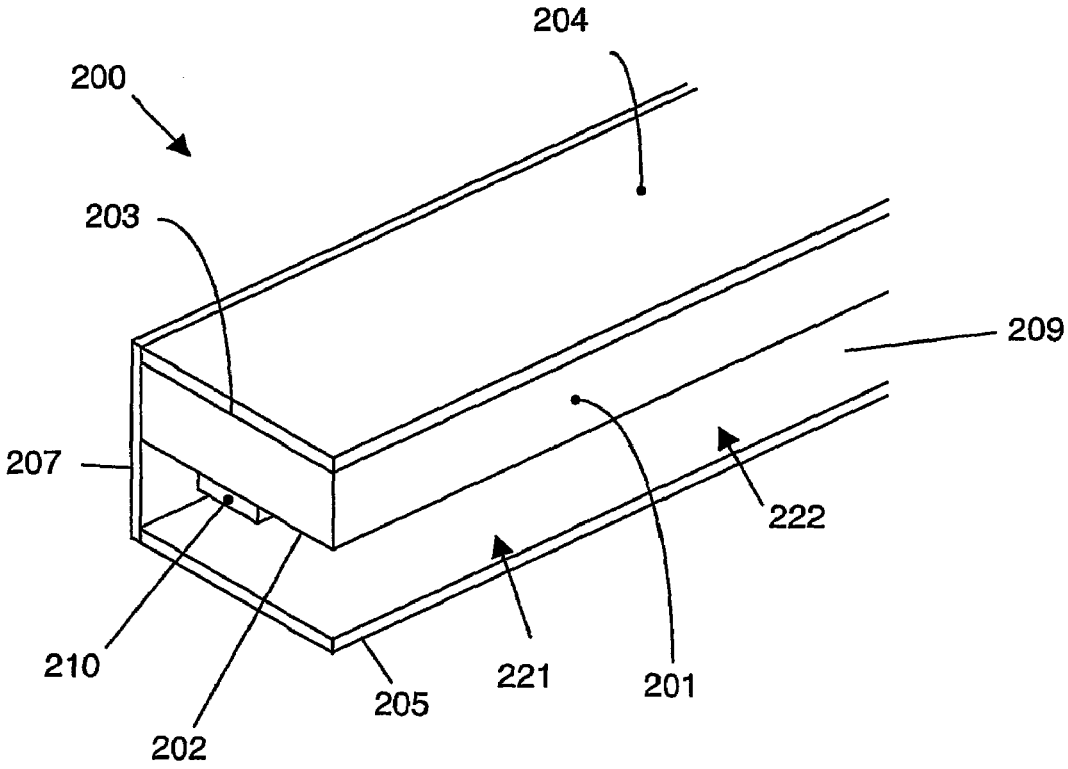
FIG. 8 is a perspective view schematically illustrating a waveguide of strip line type.

Hereinafter, a second embodiment of the multiple-conductor waveguide will be explained with reference to FIG. 8. The second embodiment of the multiple-conductor waveguide 200 is of microstrip type. This microstrip waveguide 200 comprises a strip 201 of a dielectric material, having a first surface 202 (in this case: the bottom surface) carrying a strip 210 of a conductive material. This first or bottom surface 202 will hereinafter also be referred to as front surface. A second surface 203 opposite the front surface 202, hereinafter referred to as back surface 203, carries a second strip of conductive material 204. This second strip 204, which will also be referred to as back conductor 204, has a width wider than the width of the strip conductor 210, which will also be referred to as the first conductor, and preferably equal to the transversal dimensions of the back surface. In a preferred embodiment, the first conductor 210 and back conductor 204 are implemented as layers of a conductive material, preferably copper, arranged on the dielectric strip 201. More preferably, the dielectric strip 201 with the opposite conductors 210, 204 is implemented as a strip of PCB.

In order to reduce leakage of electromagnetic field from the microstrip waveguide, a shield conductor 205 is located opposite the first conductor 210, at a suitable distance.

Preferably, but not necessarily, the back conductor 204 is electrically connected to the shield conductor 205 by means of a side conductor 207.

This side conductor 207 may be implemented as a strip of metal. The side conductor 207 may be soldered to the back conductor 204 and the shield conductor 205. Then, the combination of back conductor 204, side conductor 207, and shield conductor 205 will form a combined conductor having a substantially U-shaped cross-section, with the first conductor 210 being located in an interior space 221 between the two legs 204, 205 of this U-shaped combination. The interior space 221 is accessible from the side opposite the side conductor 207 through a slot 222. Further, the side conductor 207 may serve to keep the strip conductor 201 and the shield conductor 205 at a predetermined distance from each other, with a gap 209 between them.

Figure 9A:
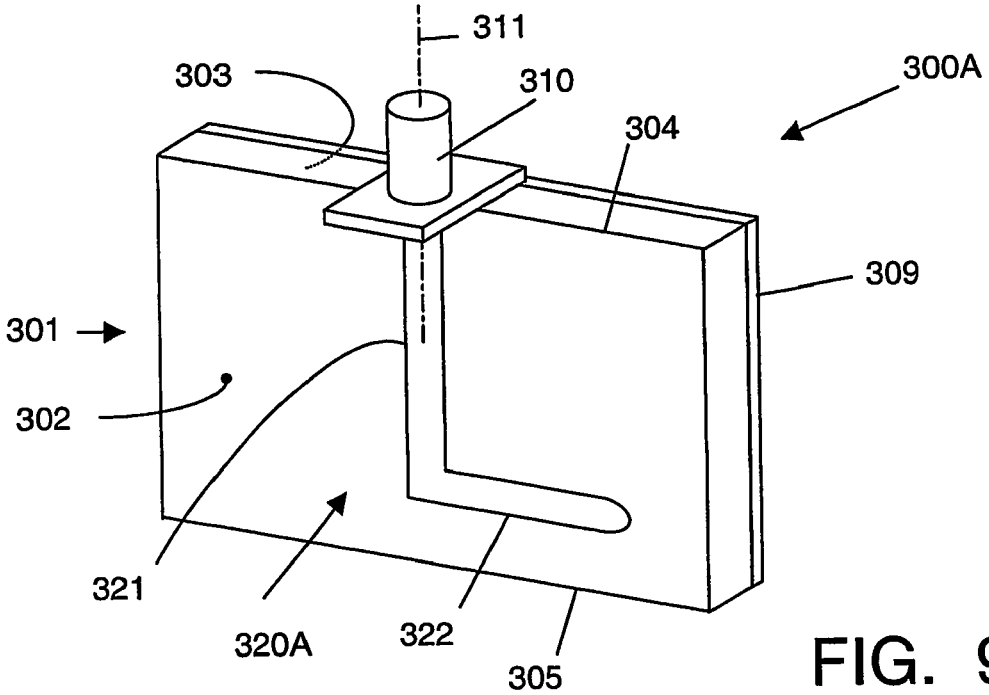
FIGS. 9A–9C are perspective views schematically illustrating several embodiments of a coupler.
Figure 9B:
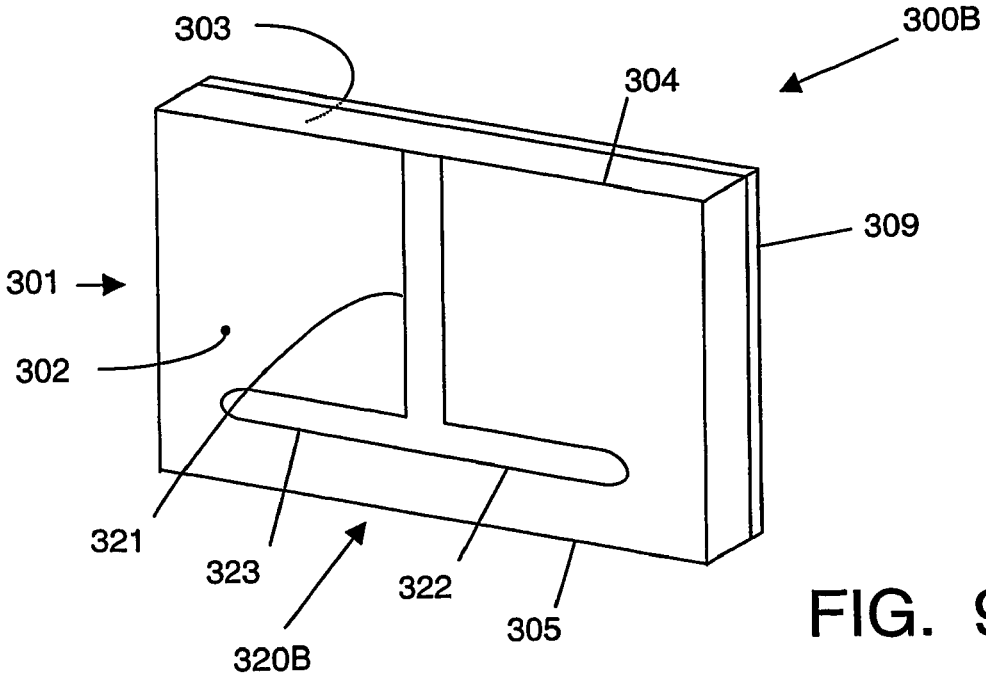
Figure 9C:
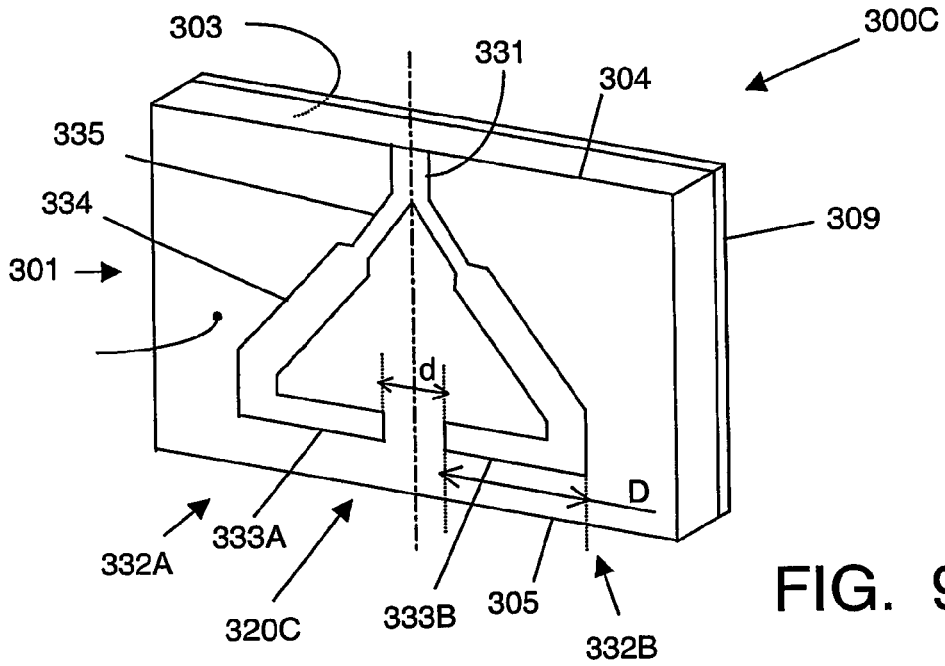

FIGS. 9A–9C illustrate several embodiments of a coupler according to the present invention, specifically suitably for introduction into a slot 122 of the outer waveguide conductor 120 and coupling with the inner waveguide conductor 110. A coupler 300 illustrated in FIG. 9A has a general planar shape. The coupler 300 comprises a carrier plate 301 of a dielectric material, having a front surface 302 and a back surface 303, and two opposite side edges 304, 305, intended to be placed in the longitudinal direction of the waveguide. On the front surface 302, a coupling conductor 320 is arranged. The coupling conductor 320 may advantageously be implemented as a conductive layer on the front surface 302. On the back surface 303, a back conductor 309 is arranged. The back conductor 309 covers a large area of the back surface 303, and preferably covers the entire back surface 303. Advantageously, the back conductor 309 is formed as a metallic layer on the back surface 303. Advantageously, the carrier plate 301 with the coupling conductor 320 and the back conductor 309 may be implemented as a double-sided PCB.

Preferably, and as illustrated in FIG. 9A, the coupler 300 comprises a connector 310 for connecting a coaxial cable (not shown), which advantageously is mounted at a side edge 304. The coaxial connector 310 comprises an inner conductor electrically connected to the coupling conductor 320, and a cylindrical outer conductor, which is electrically connected to the back conductor 309. The connector 310 may be mounted, as illustrated, with its central axis 311 in the plane of the front surface 302.

The embodiment illustrated in FIGS. 9B–9C also may have such connector 310, but this connector is not shown in the FIG. 9B–9C for the sake of simplicity.

In the following, a coupler in general will be indicated with reference numeral 300; in order to specifically refer to specific embodiments illustrated in FIGS. 9A–9C, these embodiments will be distinguished by adding the character A, B, C, respectively.

In the couplers 300, the coupling conductor 320 is implemented as a strip line, i.e. a flat strip of conductive material, typically copper, having a predetermined width and a predetermined thickness. In the coupler 300A illustrated in FIG. 9A, the coupling conductor 320A has a substantially L-shaped contour, comprising a leg portion 321 and a foot portion 322. The longitudinal direction of the foot portion 322 is substantially parallel to the second side edge 305, opposite the first side edge 304 at which the coaxial connector 310 is mounted. The leg portion 321 has its longitudinal direction substantially aligned with the inner conductor 311 of the coaxial connector 310. The width and thickness of the leg portion 321 and foot portion 322 are chosen such that the characteristic impedance of the coupler 320 is equal to the characteristic impedance of the cable to be connected to the connector 310, which typically will be 50 Ohm, although other standard impedances are also known.

Figure 10:
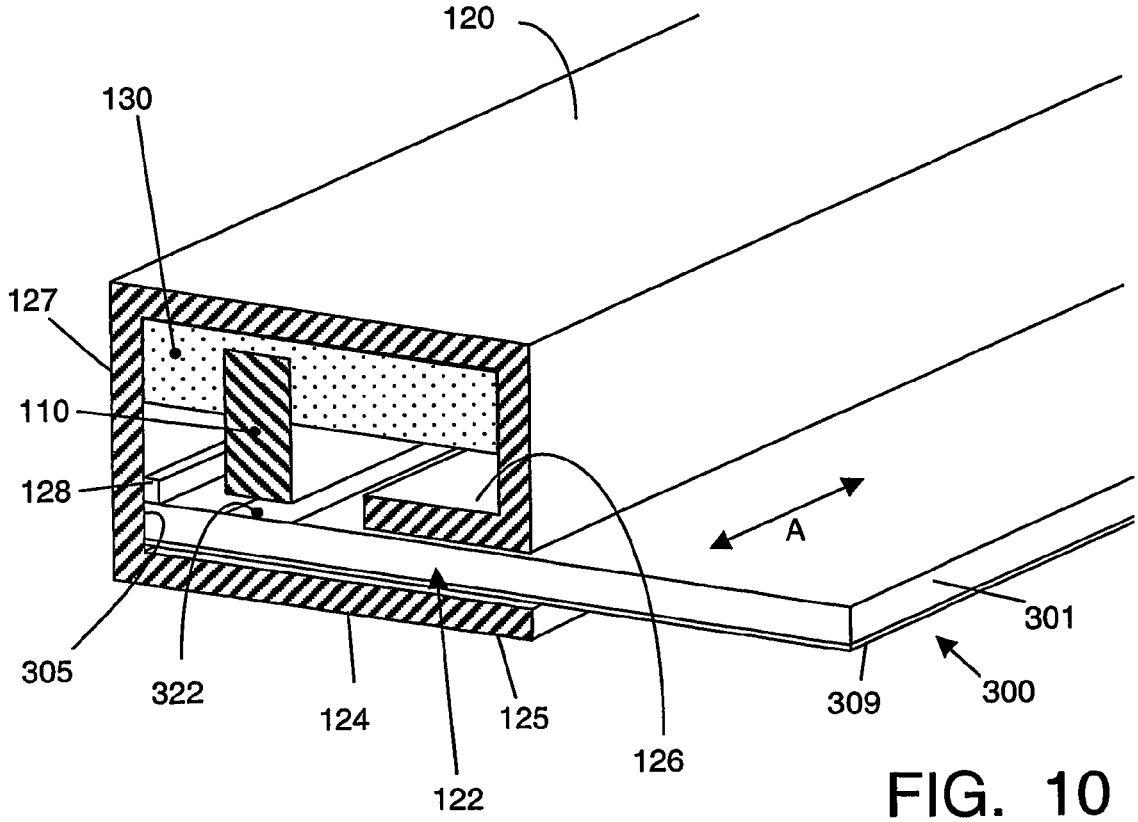
FIG. 10 is a perspective view schematically illustrating the use of a coupler with a waveguide.

FIG. 10 is a perspective view illustrating the use of a coupler 300 in conjunction with a waveguide 100 of the present invention. In use, the coupler 300 is inserted into the slot 122 of the second conductor 120, such that the foot portion 322 of coupling conductor 320 faces the first conductor 110 of the waveguide 100. The second side edge 305 may take reference to a guide member, in this case a side wall 127 of the second conductor 120. The coupler 300 can be displaced in the slot 122 of the second conductor 120, as indicated by arrow A, in which case the coupling foot portion 322 of the coupling conductor 320 is displaced along the first conductor 110 of the waveguide, the mutual distance between this coupling foot portion 322 and the first conductor 110 of the waveguide remaining constant.

In the case of the coupler picking up signal from the waveguide, the coupling foot portion 322 of the coupling conductor 320 will pick up part of the electromagnetic field generated by the first conductor 110 of the waveguide, and this will be transferred to the connector 310 for further processing. Similarly, in the case of the coupler introducing signal into the waveguide, the first conductor 110 of the waveguide will pick up part of the electromagnetic field generated by the coupling foot portion 322 of the coupling conductor 320, and this will be transferred along the first conductor 110 of the waveguide for further processing. During and after displacement of the coupler 300 in the longitudinal direction of the waveguide, the coupling area of the coupling conductor 320 is determined by the length D of its foot portion 322 and no physical contact occurs between the first conductor 110 of the waveguide and the coupling conductor 320.

In order to keep the mutual distance between the first conductor 110 of the waveguide and the coupling conductor 320 constant, external supports not shown in the Fig. may be provided. Such supports should preferably be arranged such as to assure that the coupling conductor 320 stays free from flange 126 of the second conductor 120, while preferably also assuring that the back conductor 309 stays free from side wall 124 of the second conductor 120. If desired, one or more guiding rails 128 may be arranged on an inner wall 127 of the second conductor 120, in order to effectively guide the second side edge 305 of the carrier plate 301 in order to avoid any possible movement of the carrier plate 301 in a direction perpendicular to the front surface 302.

The design should be such that electrical contact between the conductive parts of the coupler 300 on the one hand, and the conductive parts of the waveguide 100 on the other hand, is avoided. This applies specifically to the coupling conductor 320, but preferably also to the back conductor 309. In a possible embodiment, the width of the slot 122 of the second conductor 120 is slightly wider than the thickness of the coupler 300, so that there is little play in a direction perpendicular to the surface 302 of the coupler 300. However, it is also possible that the width of the slot 122 of the second conductor 120 corresponds to the thickness of the coupler 300, so that the coupler 300 is supported and guided by the flanges of the outer waveguide conductor.

Electrical contact between the leg portion 321 of the coupling conductor 320 on the one hand, and the flange 126 of the outer waveguide conductor 120 on the other hand, can be prevented in various ways. In the embodiment shown in FIG. 9A, said leg portion lies exposed on the front surface 302. Alternatively, said leg portion 321 may lie in a recessed portion or groove (not shown for sake of simplicity). The same applies to the foot portion 322 of the coupling conductor 320, in order to prevent contact with the flange 126 or with the first waveguide conductor 110.

Also, an insulating layer (not shown for sake of simplicity) may be applied over the coupling conductor 320, or over the entire front surface 302 of the coupler 300.

Also, an insulating layer (not shown for sake of simplicity) may be applied over the surface of the flange 126 facing the coupler 300, or over the entire surface of the coupler 300.

Electrical contact between the foot portion 322 of the coupling conductor 320 on the one hand, and the inner waveguide conductor 110 on the other hand, can be prevented in various ways. In the embodiment shown in FIG. 9A, said inner waveguide conductor 110 is arranged at a higher level than the flange 126 of the outer waveguide conductor 120. Also, an insulating layer (not shown for sake of simplicity) may be applied over the surface of the inner waveguide conductor 110 facing the coupler 300. It is even possible that the inner waveguide conductor 110 is completely embedded in the non-conductive support material 130.

In those cases where electrical contact is prevented by insulating material or by a recessed arrangement, the coupler 300 may physically bear against the inner waveguide conductor 110 and/or the outer waveguide conductor 120 for guidance.

The coupler 300A illustrated in FIG. 9A is sensitive mainly to an electromagnetic field travelling in one direction of the waveguide. FIG. 9B shows a modification 300B of the coupler 300A, which is sensitive to waves travelling in any direction in the waveguide. In the coupler 300B, the coupling conductor 320B has a substantially T-shaped contour, having a leg portion 321 and two opposite foot portions 322 and 323.

The coupler 300C illustrated in FIG. 9C has a substantially Δ-shaped contour. The coupling conductor 320 is symmetrical with respect to a center line 330, substantially perpendicular to the second side edge 305. Similar to the second embodiment 300B illustrated in FIG. 9B, this third embodiment 300C is sensitive to waves travelling in any of the longitudinal directions of the waveguide. A common connection portion 331 divides into two branches 332A, 332B, each branch 332A, 332B comprising a foot portion 333A, 333B, respectively, having its longitudinal direction substantially parallel to the second side edge 305, these foot portions 333A, 333B each having a length D and terminating at a distance d from each other. At their ends facing away from each other, the coupling portions 333 are connected to the common connection portion 331 by leg portions 334, each leg portion 334 having a first leg portion 335 directly adjacent the connection portion 331, the first leg portion 335 having a length equal to $\lambda/4$ and having a characteristic impedance equal to $\sqrt{2}$ times the characteristic impedance of the connection portion 331, whereas the remaining portion of the leg portion 334 and the coupling foot portion 333 each have a characteristic impedance equal to the characteristic impedance of the connection portion 331.

With respect to the three exemplary embodiments 300A, 300B, 300C of the coupler according to the present invention, the coupler 300A represents the easiest design and the smallest dimensions.

The couplers 300B and 300C are examples of bidirectional couplers, having symmetrical structures.

Further, it is noted that the waveguide and coupler as illustrated are suitable for use in a wide range of operating frequencies. This applies also to the Δ-shaped coupler 300C illustrated in FIG. 9C, although to a lesser extent since the length of first leg portions 335 should be determined in relation to the operating frequency. Further, since the coupling efficiency depends on the length of the coupling foot portion (322A; 322B+323B; 333A, 333B) of the coupling conductor 320 in relation to the operating frequency, it is possible to optimize coupling by adapting said length to a design operating frequency (a good value is about λ/4), although in this respect the couplers perform well also in a wide band around the design operating frequency. In the third embodiment 300C, the distance d between the two foot portions 333A, 333B should be made small in relation to the design operating frequency (preferably a fraction of λ).

Further, it is noted that the mutual distance between first conductor 110 and strip conductor 322 can be optimized for optimal coupling efficiency, although this distance is not critical. Generally, the smaller the distance the better the coupling. However, if the distance is made too small, the properties of the waveguide itself are disturbed. One can conclude that there is an optimal distance between the coupler and the waveguide for each application or a range of distances where the performance is sufficiently good.

FIG. 11A schematically illustrates an apparatus 400, such as an industrial manufacturing apparatus, comprising a command unit 402 and an actuator 403, wherein in this example the actuator 403 is mobile, as indicated with arrow A. Signals from command unit 402 to actuator 403 are transferred through a waveguide communication system 401, which comprises a waveguide 100; 200 as discussed above and at least one coupler 300 as discussed above, slideably fitting to said waveguide 100; 200.

FIG. 11B schematically illustrates an apparatus 410, such as an industrial manufacturing apparatus, comprising a detector 412 and a receiver 411, wherein in this example the detector 412 is mobile, as indicated with arrow A. Signals from detector 412 to receiver 411 are transferred through a waveguide communication system 401, which comprises a waveguide 100; 200 as discussed above and at least one coupler 300 as discussed above, slideably fitting to said waveguide 100; 200.

It should be clear to a person skilled in the art that the present invention is not limited to the exemplary embodiments discussed above, but that various variations and modifications are possible within the protective scope of the invention as defined in the appending claims.

For instance, in the above examples, the second conductor of the multiple-conductor waveguide of the present invention is illustrated as having one longitudinal slot for allowing introduction of a coupler. However, it is also possible that the second conductor of the multiple-conductor waveguide is provided with two or even more longitudinal slots, each such slot allowing introduction of a coupler. Then, respective couplers introduced in respective slots can be moved over the entire length of the waveguide, irrespective of each others position, because couplers introduced in respective slots can now pass each other.

Further, in the above examples, the coupler is illustrated as being substantially plate-shaped. However, it is also possible to use couplers of a different design, for instance a wire-type design.

In the above, it has been explained how a waveguide communication system can be designed, comprising a multi-conductor waveguide and a coupler sliding along such waveguide, such that a predetermined coupling conductor (322) couples with the first conductor of the waveguide. Further, a new design for a waveguide has been described, especially suitable for use in such a waveguide communication system, and a new design for a coupler has been described, especially suitable for use in such a waveguide communication system. However, the basic idea of the present invention, i.e. the use of a coupler to slide along a multi-conductor waveguide, is considered new and inventive per se, even when practiced with a multi-conductor waveguide known per se, because up to date a multi-conductor waveguide has never been used in the inventive way as proposed by the present invention. This applies specifically to a multi-conductor waveguide of microstrip type. With reference to FIG. 8, a bare microstrip type multi-conductor waveguide essentially consists of the first conductor 210 and the back conductor 204, i.e. without shield conductor 205 and without side conductor 207. The basic idea of the present invention can very well be practiced with such a bare microstrip type multi-conductor waveguide.

The invention claimed is:

1. Waveguide communication system, comprising a waveguide which comprises at least two mutually parallel conductors, and at least one coupler slideably fitting to said waveguide, wherein the parallel conductors are supported by a plurality of discontinuous supports each having dimensions smaller than a predetermined operating wavelength.

2. Waveguide, comprising:

a longitudinal first conductor;

a longitudinal second conductor running substantially in parallel with said first conductor;

wherein the second conductor at least substantially surrounds an interior such that an electromagnetic field will be substantially confined within this interior;

wherein said first conductor is located inside said interior of the second conductor;

at least part of said interior adjacent said first conductor being empty;

wherein the second conductor has at least one slot communicating with said empty part of said interior, allowing introduction of a coupler, wherein said first conductor is supported with respect to said longitudinal second conductor by a plurality of discontinuous supports each having dimensions smaller than a predetermined operating wavelength.

3. Waveguide according to claim 2, wherein said first conductor is supported with respect to said longitudinal second conductor by a continuous support.

4. Waveguide according to claim 2, wherein said first conductor has a substantially circular cross-section, or a substantially rectangular cross-section, or a substantially square cross-section, or a substantially triangular cross-section, or a substantially D-shaped cross-section.

5. Waveguide according to claim 2, wherein said slot is located at a central portion of a side wall.

6. Waveguide according to claim 2, wherein said slot is located near an edge of a side wall, adjacent a neighboring side wall.

7. Waveguide according to claim 2, further comprising flanges extending substantially parallel to each other on opposite sides of the slot.

8. Waveguide according to claim 7, wherein the flanges extend outwards with respect to the second conductor, and wherein a first flange extends in line with an adjacent side wall.

9. Waveguide according to claim 7, wherein at least one flange extends inwards with respect to the second conductor, and wherein one flange extends substantially parallel to an adjacent side wall.

10. Waveguide according to claim 2, wherein said first conductor is shaped as a strip of conductive material, and wherein a back conductor is shaped as a wider strip of conductive material arranged parallel to said first conductor.

11. Waveguide according to claim 10, wherein said first conductor and said back conductor are formed on opposite surfaces of a strip of a dielectric material, preferably implemented as a strip of PCB.

12. Waveguide according to claim 10, further comprising a shield conductor located parallel to the first conductor opposite to the back conductor, said shield conductor possibly being implemented as a strip of PCB.

13. Waveguide according to claim 12, wherein said shield conductor is electrically connected to said back conductor by a side conductor, said side conductor preferably being implemented as a strip of metal or a strip of PCB.

14. Waveguide according to claim 2, further comprising at least one reflector at least one end thereof.

15. Waveguide according to claim 2, further comprising at least one terminator at least one end thereof, the terminator having an impedance matching the impedance of the waveguide.

16. Coupler for coupling a signal out of or into a waveguide according to any of the previous claims, comprising:

a carrier plate of a dielectric material;

a coupling conductor arranged on a front surface of the carrier plate;

a back conductor arranged on a back surface of the carrier plate.

17. Coupler according to claim 16, implemented as a double-sided PCB.

18. Coupler according to claim 16, wherein said coupling conductor comprises at least one longitudinal portion arranged substantially parallel to a first side edge of the carrier plate.

19. Coupler according to claim 18, wherein said coupling conductor comprises at least one longitudinal portion arranged substantially perpendicular to said first side edge of the carrier plate.

20. Coupler according to claim 19, wherein said coupling conductor comprises two longitudinal portions meeting each other at one end of said perpendicular portion, arranged substantially parallel to said first side edge and directed in opposite directions with respect to said perpendicular portion.

21. Coupler according to claim 18, wherein said coupling conductor comprises:

two longitudinal portions each having a length D and arranged substantially parallel to said first side edge at a mutual distance d from each other;

a common connection portion arranged substantially perpendicular to said first side edge of the carrier plate;

two leg portions, each leg portion connecting an outer end of a longitudinal portion with an end of said common connection portion.

22. Coupler according to claim 21, wherein each leg portion comprises a first leg portion directly adjacent said common connection portion, the first leg portion having a length substantially equal to $\lambda/4$ and having a characteristic impedance equal to $\sqrt{2}$ times the characteristic impedance of the connection portion, whereas the remaining portion of each leg portion as well as said longitudinal portions each have a characteristic impedance equal to the characteristic impedance of the connection portion.

23. Coupler according to claim 16, further comprising a connector for connecting a coaxial cable;

said coaxial connector comprising an inner conductor electrically connected to the coupling conductor, and a cylindrical outer conductor, which is electrically connected to said back conductor;

wherein said connector is preferably located near a second side edge opposite said first side edge.

* * * * *